US008579243B2

(12) United States Patent
Leary et al.

(10) Patent No.: US 8,579,243 B2
(45) Date of Patent: Nov. 12, 2013

(54) METHOD AND APPARATUS FOR INSTALLING A POST MOUNT

(75) Inventors: Steven J. Leary, Barnegat, NJ (US); Benjamin Yin, Hong Kong (HK)

(73) Assignee: Vinylast, Inc., Lakewood, NJ (US)

( * ) Notice: Subject to any disclaimer, the term of this patent is extended or adjusted under 35 U.S.C. 154(b) by 243 days.

(21) Appl. No.: 12/711,841

(22) Filed: Feb. 24, 2010

(65) Prior Publication Data

US 2011/0204198 A1 Aug. 25, 2011

(51) Int. Cl.

| | |
|---|---|
| ***A47B 96/06*** | (2006.01) |
| ***E04G 5/06*** | (2006.01) |
| ***F16M 13/00*** | (2006.01) |
| ***E02D 27/32*** | (2006.01) |
| ***E04H 12/00*** | (2006.01) |

(52) U.S. Cl.

USPC ..... 248/219.2; 248/188.1; 248/231.31; 248/523; 248/218.4; 52/296; 52/301; 52/298; 52/293.2; 52/297

(58) Field of Classification Search

USPC ..... 248/219.2, 188.1, 231.31, 523, 218.4; 52/296, 301, 298, 293.2, 297

See application file for complete search history.

(56) References Cited

U.S. PATENT DOCUMENTS

| | | | | |
|---|---|---|---|---|
| 4,118,002 | A * | 10/1978 | Bartlett | 248/311.2 |
| 4,143,843 | A * | 3/1979 | Ehrens et al. | 248/544 |
| 5,299,769 | A * | 4/1994 | Reusche et al. | 248/219.2 |
| 5,400,997 | A * | 3/1995 | Payne et al. | 248/523 |
| 6,141,928 | A * | 11/2000 | Platt | 52/296 |
| 6,718,710 | B2 * | 4/2004 | Platt | 52/296 |
| 6,948,283 | B2 * | 9/2005 | Burkart et al. | 52/155 |
| 7,278,240 | B2 * | 10/2007 | Burkart et al. | 52/155 |
| 7,438,214 | B2 * | 10/2008 | Riker et al. | 232/39 |
| 7,533,506 | B2 * | 5/2009 | Platt | 52/296 |
| 7,546,720 | B2 * | 6/2009 | Leary | 52/745.17 |
| 7,677,000 | B2 * | 3/2010 | Walker | 52/296 |
| 7,722,014 | B2 * | 5/2010 | Godwin | 256/65.14 |
| 2003/0221385 | A1 * | 12/2003 | Platt | 52/296 |
| 2007/0158526 | A1 * | 7/2007 | Platt | 248/519 |
| 2007/0215767 | A1 * | 9/2007 | Leary | 248/214 |
| 2009/0320396 | A1 * | 12/2009 | Knudsen | 52/297 |

* cited by examiner

*Primary Examiner* — Terrell McKinnon
*Assistant Examiner* — Christopher Garft

(57) ABSTRACT

In one embodiment, the invention is a method and apparatus for installing a post mount. In one embodiment, a support block for use in securing a post mount includes a body having a first end and a second end and an adjustment mechanism formed integrally with the first end of the body, by which a vertical orientation of a post mount incorporating the support block can be adjusted.

7 Claims, 5 Drawing Sheets

METHOD AND APPARATUS FOR INSTALLING A POST MOUNT

FIELD OF THE INVENTION

The present invention relates generally to railing systems and relates more specifically to support hardware for use in railing installations.

BACKGROUND OF THE DISCLOSURE

Post mounts are frequently used in the construction of decks, porches, stairs, and other structures that include railings. FIG. 1, for example, is a schematic illustration of a portion of an exemplary railing system 100, including a post mount 108. The railing system 100 comprises a railing 102, a support surface 104, and a plurality of posts $\mathbf{106}_1$-$\mathbf{106}_n$ (hereinafter collectively referred to as "posts 106"). Generally, the rail 102 is supported in a spaced-apart relation relative to the support surface 104 by the posts 106.

In order to mount the posts 106 to the support surface 104 (which may comprise, for example, wood or concrete) in a substantially invisible manner (i.e., little or no outwardly visible hardware), post mounts are often first installed in the support surface 104. For example, the post $\mathbf{106}_1$ is mounted to the support surface via a post mount 108 (illustrated in phantom). Specifically, the post mount 108 is fastened to the support surface 104 in a secure manner, and the hollow post $\mathbf{106}_1$ is then slipped over the post mount 108, like a sleeve. In this manner, the post $\mathbf{106}_1$ is supported securely by the support surface 104 and in turn provides secure support for the railing 102.

The railing system 100 is most structurally sound when the posts 106 are oriented plumb with the vertical direction (e.g., substantially perpendicular to the support surface 104). In order to orient a post 106 plumb in the vertical direction, the post 106 may need to be moved or adjusted in a desired direction. Conventionally, this involves placing wedge shims under the flange at the bottom of the post mount 108 or a using a series of leveling screws that are tightened and/or loosened in a specific order. Such techniques, however, may be tedious and imprecise. In addition, if the post 106 shifts after installation (e.g., due to settling or concrete uplift), the entire affected portion of the railing system 100 must be taken apart, adjusted, and re-assembled.

SUMMARY OF THE INVENTION

In one embodiment, the invention is a method and apparatus for installing a post mount. In one embodiment, a support block for use in securing a post mount includes a body having a first end and a second end and an adjustment mechanism formed integrally with the first end of the body, by which a vertical orientation of a post mount incorporating the support block can be adjusted.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

In one embodiment, the invention is a method and apparatus for installing a post mount. Embodiments of the present invention allow a post to be leveled and plumbed quickly and easily after being installed over a post mount. Moreover, the post can be easily adjusted if it becomes out of plumb after installation (e.g., due to settling or uplift of the support surface).

Figure 1:
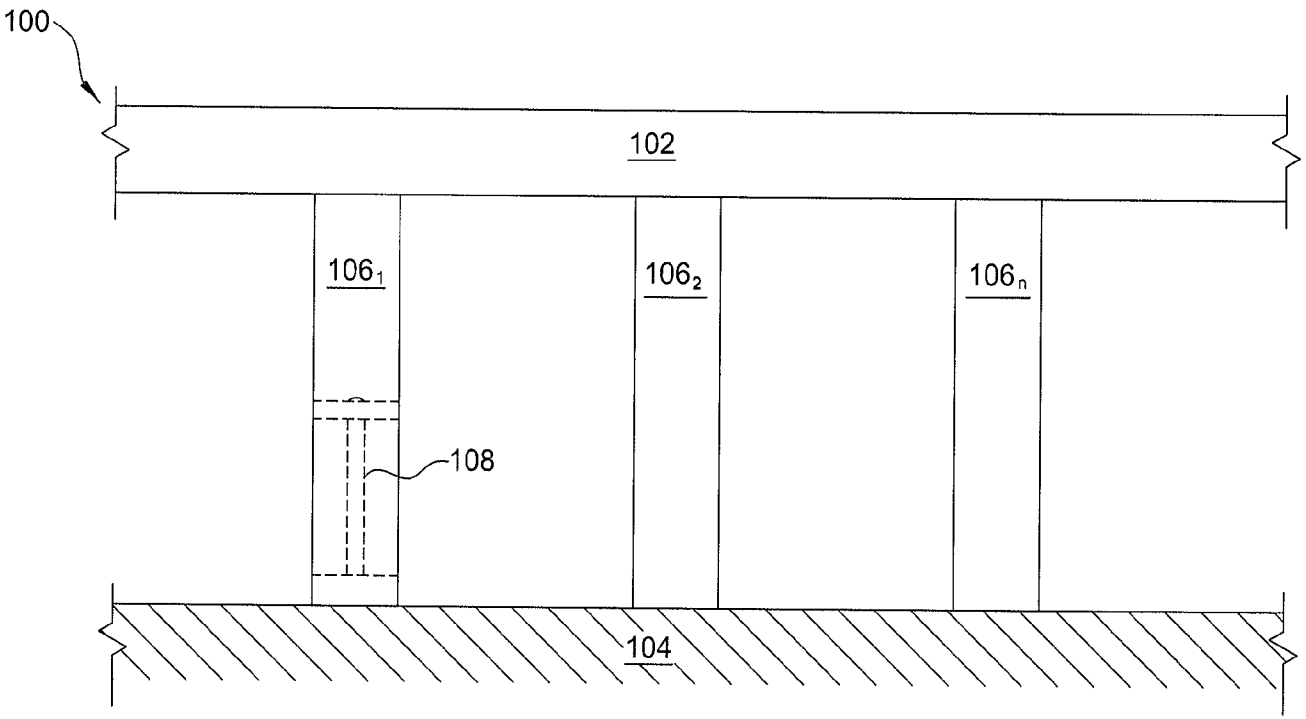
FIG. 1 (PRIOR ART)
FIG. 1 is a schematic illustration of a portion of an exemplary railing system, including a post mount.
Figure 2:
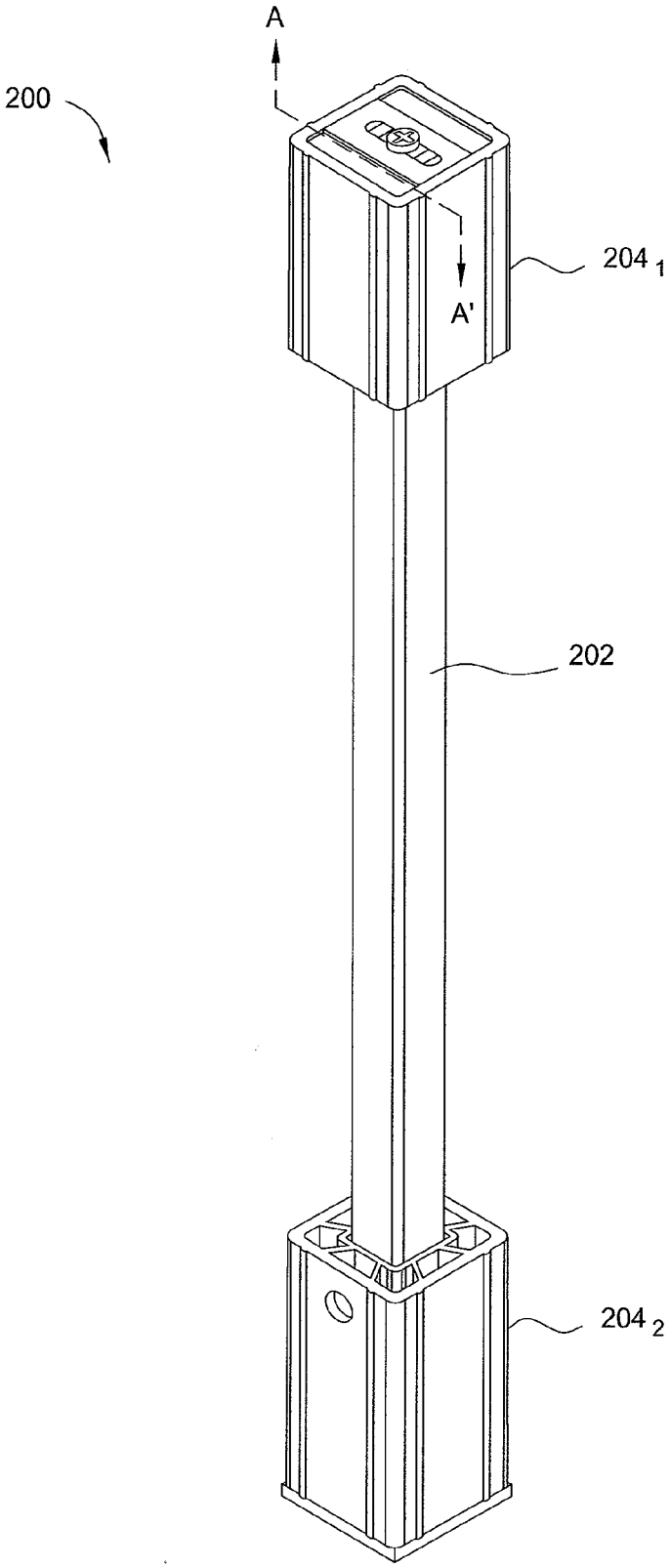
FIG. 2 is an isometric view of one embodiment of a post mount, according to the present invention.

FIG. 2 is an isometric view of one embodiment of a post mount 200, according to the present invention. The post mount 200 comprises a support pipe 202 supported between a first support block $\mathbf{204}_1$ and a second support block $\mathbf{204}_2$ (hereinafter collectively referred to as "support blocks 204"). In installation, the second support block $\mathbf{204}_2$ is mounted to a support surface (e.g., a wood or concrete support surface) such that a hollow post may be slipped over the post mount 200, as described above. The first support block $\mathbf{204}_1$ is mounted to a railing after the post is slipped over the post mount 200. The outer perimeters of the support blocks 204 are sized to be slightly smaller than the inner perimeter of a post slipped thereover, such that the post is snugly supported by the support blocks 204.

Figure 3:
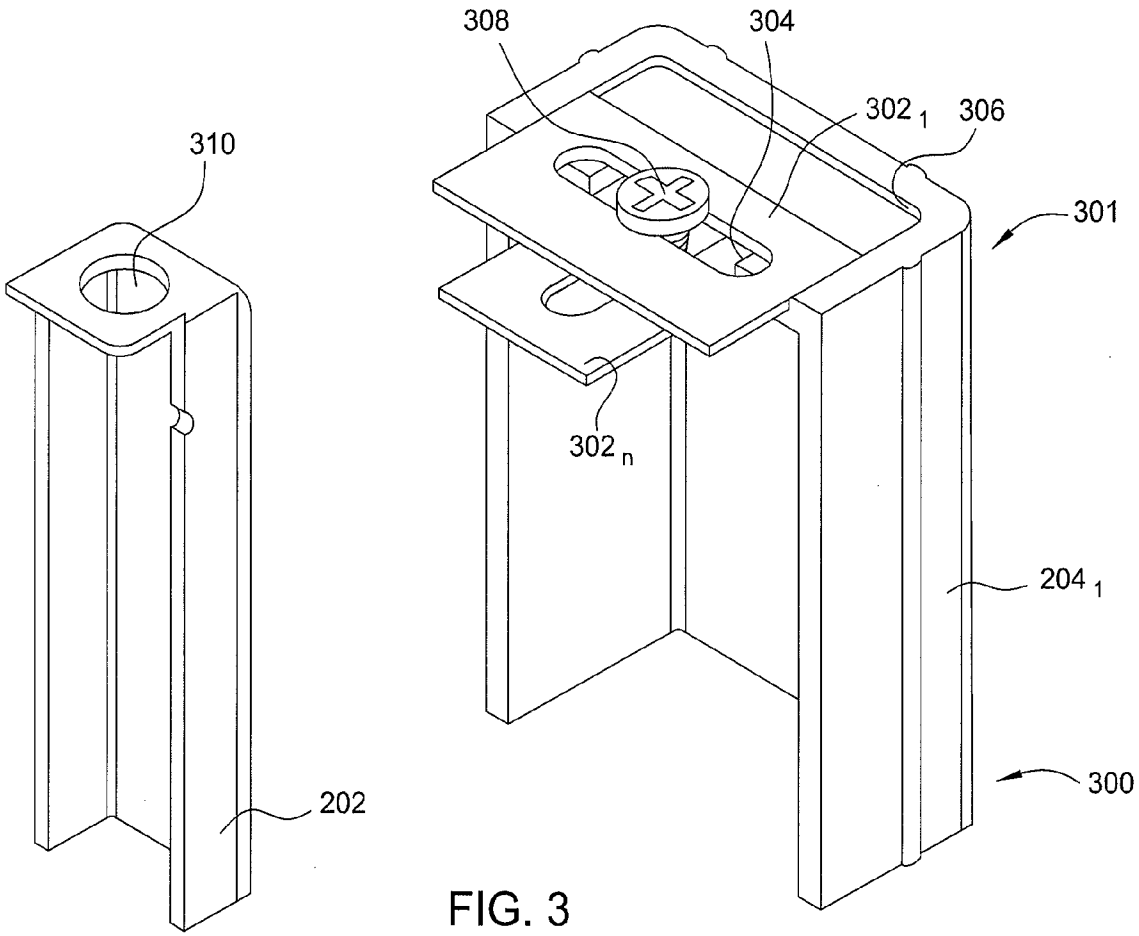
FIG. 3 is an exploded view of the support pipe and support block illustrated in FIG. 2.
Figure 4:
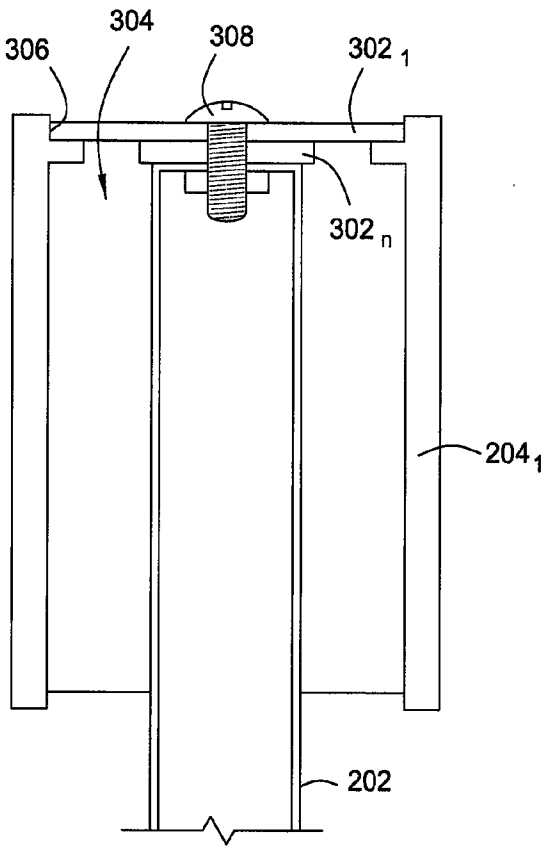
FIG. 4 is a cross sectional view of the support block, taken along line A-A' of FIG. 2.

FIG. 3 is an exploded view of the support pipe 202 and support block 204 illustrated in FIG. 2. FIG. 4 is a cross sectional view of the support block 204, taken along line A-A' of FIG. 2. Specifically, the support block 204 illustrated in FIGS. 3 and 4 corresponds to the first support block $\mathbf{204}_1$ illustrated in FIG. 2 (i.e., a "top" support block that is designed to be mounted to a railing). As illustrated, the first support block $\mathbf{204}_1$ is an elongated block having a substantially square cross-section. In one embodiment, the first support block $\mathbf{204}_1$ is formed of a rigid plastic or composite, such as polypropylene, polyethylene or the like.

Referring simultaneously to FIGS. 3 and 4, the first support block $\mathbf{204}_1$ comprises a substantially hollow body. The first support block $\mathbf{204}_1$ has a larger perimeter than the support pipe 202, such that the support pipe 202 fits within the hollow interior of the first support block $\mathbf{204}_1$. A first end 300 of the first support block $\mathbf{204}_1$ is substantially open and is designed to receive the support pipe 202, while a second end 301 of the first support block $\mathbf{204}_1$ is substantially closed and is designed to be secured to the support pipe 202. Although the second end 301 is substantially closed, it does include an aperture 304 formed approximately in the center of the surface of the second end 301.

In particular, the second end 301 of the first support block $\mathbf{204}_1$ comprises a plurality of plates $\mathbf{302}_1$-$\mathbf{302}_n$ (hereinafter collectively referred to as "plates 302") that are designed to secure the first support block $\mathbf{204}_1$ to the support pipe 202 in an adjustable manner. In the illustrated embodiment, the second end 301 of the first support block $\mathbf{204}_1$ comprises two plates: a first plate $\mathbf{302}_1$ and a second plate $\mathbf{302}_n$.

Figure 5:
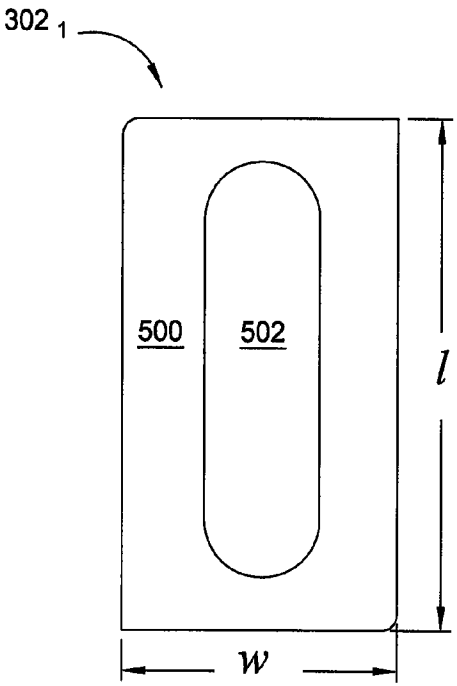
FIG. 5 is a plan view illustrating one embodiment of the first plate illustrated in FIGS. 3-4.

FIG. 5 is a plan view illustrating one embodiment of the first plate $\mathbf{302}_1$ illustrated in FIGS. 3-4. The second plate 302, is substantially identical to the first plate $\mathbf{302}_1$ illustrated in FIG. 5. As illustrated, the first plate $\mathbf{302}_1$ comprises a rectangular plate having a substantially flat surface 500. The dimensions of the first plate $\mathbf{302}_1$ are defined at least by a length, l, and a width, w. In one embodiment, the length, l, of the first plate $\mathbf{302}_1$ is slightly smaller than the cross-sectional length of a side of first support block $\mathbf{204}_1$. For instance, the length, l, of the first plate $\mathbf{302}_1$ is sized such that the first plate $\mathbf{302}_1$ fits securely within a lip 306 extending around a perimeter of the second end 301 of the first support block $\mathbf{204}_1$. The width, w, of the first plate $\mathbf{302}_1$ is shorter than the length, l, of the first plate $\mathbf{302}_1$.

As also illustrated, the first plate $\mathbf{302}_1$ comprises an aperture 502 formed within the surface 500. In one embodiment, the aperture 502 has a substantially elongated (e.g., oblong) shape. In one embodiment, the aperture 502 is positioned over the aperture 304 in the second end 301 of the first support block $\mathbf{204}_1$.

Referring back to FIGS. 3-4, the first plate $\mathbf{302}_1$ is disposed on the exterior side of the second end 301 of the first support block $\mathbf{204}_1$ (i.e., exterior to the hollow body of the first support block $\mathbf{204}_1$), while the second plate 302, is disposed on the interior side of the second end 301 (i.e., interior to the hollow body of the first support block $\mathbf{204}_1$). In one embodiment, the first plate $\mathbf{302}_1$ and the second plate 302, are positioned substantially perpendicular relative to each other (i.e., so that they form a cross shape), as illustrated in FIG. 3.

Finally, a fastener 310 is disposed through the second end 301 of the first support block $\mathbf{204}_1$. The faster 310 passes through the apertures 402 in the plates 302, as well as through the aperture 304 in the second end 301 of the first support block $\mathbf{204}_1$ and an aperture 310 in the support pipe 202. This configuration is clearly illustrated in FIG. 4. In this manner, the first support block $\mathbf{204}_1$ is securely fastened to the support pipe 202. In one embodiment, the fastener 310 is an adjustable fastener that can be easily loosened and tightened, such as a nut and bolt fastener. Thus, the plates 302 and fastener 310 together form an adjustment mechanism that is formed integrally with the first support block $\mathbf{204}_1$ (i.e., the adjustment mechanism is also part of the mechanism by which the first support block $\mathbf{204}_1$ is secured to the support pipe).

Figure 6:
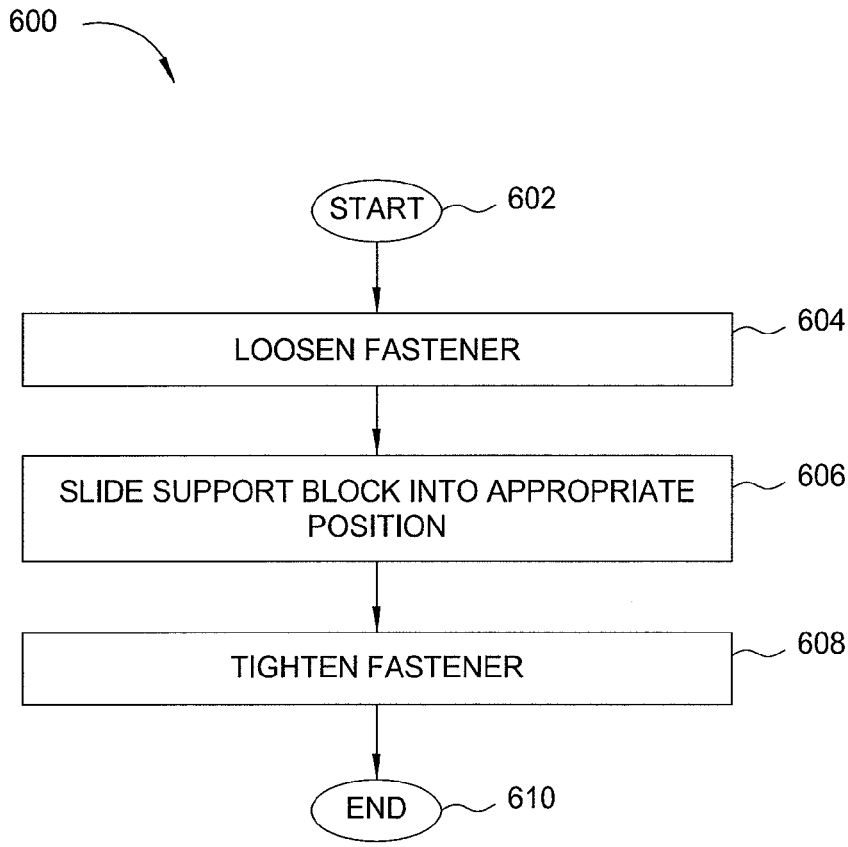
FIG. 6 is a flow diagram illustrating one embodiment of a method for adjusting a post mount so that a post placed over the post mount is plumb in the vertical direction.

The design of the first support block $\mathbf{204}_1$ allows the position of a post placed over the post mount 200 to be adjusted so that it is plumb in the vertical direction. FIG. 6, for example, is a flow diagram illustrating one embodiment of a method 600 for adjusting a post mount so that a post placed over the post mount is plumb in the vertical direction. For ease of explanation, discussion of the method 600 makes reference to elements of the post mount 200 illustrated in FIGS. 2-5.

The method 600 is initiated in step 602. In step 604, the fastener 308 is loosened until the first support block $\mathbf{204}_1$ is able to slide along the apertures 502 that are formed in the plates 302.

In step 606, the first support block $\mathbf{204}_1$ is slid into an appropriate position (i.e., so that it is plumb in the vertical direction). Because the plates 302 are arranged in a cross pattern (i.e., so that their respective apertures 502 are substantially perpendicular to each other), the first support block $\mathbf{204}_1$ can be slid freely in substantially any direction. In particular, the elongated apertures 502 in the plates 302 define paths along which the first support block $\mathbf{204}_1$ can be slid. The position of the first support block $\mathbf{204}_1$ with respect to the support pipe 202 is therefore easily adjusted.

In step 608, the fastener 308 is tightened. This secures the first support block $\mathbf{204}_1$ into place and secures the post mount 600 in the plumb position. The method 600 then ends in step 610.

The design of the first support block $\mathbf{204}_1$ therefore allows the post mount 200 (and any post positioned over the post mount 200) to be plumbed quickly and easily with the turn of a single fastener. Moreover, because the means for plumbing the post mount 200 is built into the post mount itself (i.e., built into the first support block $\mathbf{204}_1$), there is no need for secondary leveling or plumbing devices, which reduces the overall costs of constructing a railing system. Additionally, the design of the first support block $\mathbf{204}_1$ allows the post mount 200 to be easily plumbed even after installation of the railing system.

It is noted that FIGS. 2-4 illustrate only one possible relative orientation of the first support block $\mathbf{204}_1$ and the support pipe 200. Specifically, FIG. 204 illustrate a configuration in which the support pipe 202 passes through the first end 300 of the first support block $\mathbf{204}_1$ before being secured to the second end 301 of the first support block $\mathbf{204}_1$. In other embodiments, the first support block $\mathbf{204}_1$ could be flipped (e.g., "upside down") so that the support pipe does not pass through the first end 300 of the first support block $\mathbf{204}_1$. This configuration may be preferable for installation of taller posts (as the full height of the first support block $\mathbf{204}_1$ is added to the overall height of the post mount 200), but still allows for plumbing of the post mount 200 in the same manner.

Although various embodiments which incorporate the teachings of the present invention have been shown and described in detail herein, those skilled in the art can readily devise many other varied embodiments that still incorporate these teachings.

What is claimed is:

1. A support block for use in securing a post mount, the support block comprising:

a body having a first end and a second end; and an adjustment mechanism formed with the second end of the body, the adjustment mechanism comprising:

a first plate separable from the body and disposed on an exterior side of the second end; and a second plate stacked under the first plate in a direction extending from the second end to the first end, the second plate being separable from the body, fully disposed within an interior side of the second end, and positioned to collectively form a cross shape with the first plate, wherein the adjustment mechanism allows the post mount to be plumbed in a vertically aligned manner.

2. The support block of claim 1, wherein:

the first plate has a first aperture formed therein; and the second plate has a second aperture formed therein.

3. The support block of claim 2, wherein each of the first aperture and the second aperture has an oblong shape.

4. The support block of claim 2, further comprising:

an adjustable fastener disposed through the first aperture and the second aperture.

5. The support block of claim 1, wherein the support block is formed of a rigid plastic or composite.

6. The support block of claim 1, wherein an interior of the support block is substantially hollow.

7. The support block of claim 1, wherein the first end is substantially open.

* * * * *

UNITED STATES PATENT AND TRADEMARK OFFICE

CERTIFICATE OF CORRECTION

PATENT NO. : 8,579,243 B2
APPLICATION NO. : 12/711841
DATED : November 12, 2013
INVENTOR(S) : Steven J. Leary et al.

It is certified that error appears in the above-identified patent and that said Letters Patent is hereby corrected as shown below:

In the Specification

Column 2, Line 66: Delete "302," and
insert -- $302_n$ --, therefor.

Column 3, Line 22: Delete "302," and
insert -- $302_n$ --, therefor.

Column 3, Line 25: Delete "302," and
insert -- $302_n$ --, therefor.

Signed and Sealed this
Twenty-second Day of April, 2014

Michelle K. Lee

Michelle K. Lee
*Deputy Director of the United States Patent and Trademark Office*